US005554477A

United States Patent [19]

Ozawa et al.

[11] Patent Number: 5,554,477

[45] Date of Patent: Sep. 10, 1996

[54] DEVELOPER FOR DEVELOPING LATENT ELECTROSTATIC IMAGES

[75] Inventors: Yoshio Ozawa, Mie; Hisashi Mukataka; Ryushi Imoo, both of Tokyo; Satoshi Nishida, Saitama, all of Japan

[73] Assignee: Kyocera Corporation, Kyoto, Japan

[21] Appl. No.: 76,919

[22] Filed: Jun. 14, 1993

[30] Foreign Application Priority Data

Jun. 15, 1992 [JP] Japan ..... 4-180313
Dec. 28, 1992 [JP] Japan ..... 4-361689

[51] Int. Cl.[6] ..... G03G 9/107; G03G 9/113

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 3,838,054 | 9/1974 | Trachtenberg et al. | 430/106.6 |
| 4,272,184 | 6/1981 | Rezanka | 430/108 X |
| 4,683,187 | 7/1987 | Goldstein et al. | 430/106.6 |
| 5,093,201 | 3/1992 | Ohtani et al. | 428/407 |
| 5,256,513 | 10/1993 | Kawamura et al. | 430/108 X |

FOREIGN PATENT DOCUMENTS

| | | | |
|---|---|---|---|
| 0109860 | 5/1984 | European Pat. Off. . | |
| 0410414 | 1/1991 | European Pat. Off. | 430/106.6 |
| 0430038 | 6/1991 | European Pat. Off. . | |
| 0492655 | 7/1992 | European Pat. Off. . | |
| 4101773 | 7/1991 | Germany . | |
| 204560 | 12/1982 | Japan | 430/108 |
| 60-229034 | 4/1986 | Japan . | |
| 80263 | 4/1986 | Japan | 430/108 |
| 215559 | 9/1986 | Japan | 430/108 |
| 74955 | 3/1990 | Japan | 430/108 |

*Primary Examiner*—Roland Martin
*Attorney, Agent, or Firm*—Loeb and Loeb LLP

[57] ABSTRACT

A developer for developing latent electrostatic images for use in the rear side exposure system, composed of an electroconductive magnetic carrier which is composed of electroconductive magnetic carrier particles, each electroconductive magnetic carrier particle including a magnetic base particle and an electroconductive layer formed on the surface of the magnetic base particle, a magnetic high-resistivity magnetic carrier, and an electrically insulating toner; and an image formation method of forming toner images on a photoconductor by using this developer in accordance with the rear side exposure system are disclosed.

13 Claims, 5 Drawing Sheets

DEVELOPER FOR DEVELOPING LATENT ELECTROSTATIC IMAGES

BACKGROUND OF THE INVENTION

1. Field of the Invention

The present invention relates to a developer for developing latent electrostatic images to visible images in a developing process in the fields of electrophotography, electrostatic recording and electrostatic printing; and a method of forming images by using the developer.

2. Discussion of Background

According to the electrophotographic image formation method based on the Carlson process, which is now widely employed, image formation is basically carried out in such a manner that the surface of a photoconductor is uniformly charged to a predetermined polarity and the photoconductor thus charged is selectively exposed to the original light images to form latent electrostatic images on the photoconductor. Then, the latent electrostatic images are developed with a developer, so that visible toner images can be obtained on the photoconductor. The visible toner images are then transferred to a sheet of an image-receiving medium and fixed thereon.

On the other hand, many proposals on the image formation method not using the Carlson process, but using the rear side exposure system have been reported, for example, in The Journal of the Institute of Image Electronics Engineers of Japan vol. 16, (5), 306 (1987); and Japanese Laid-Open Patent Applications 61-149968, 63-10071 and 63-214781, by which rear side exposure system the image formation apparatus can be made compact and the image formation process can be made simple.

In the rear side exposure system, the surface of the photoconductor is provided with a developer to form a developer resident portion, through which the photoconductor is subjected to a cleaning operation, and the photoconductor is uniformly charged. The light images are applied to the photoconductor from the rear side thereof and the latent images formed on the surface of the photoconductor are simultaneously developed into toner images with the developer.

However, there are too many difficult problems in the rear side exposure system to put it into practice. More specifically, the requirements for each function in the rear side exposure system are made extremely severe because it is necessary to inject the electric charge sufficient for the development into the photoconductor through the developer accumulated in the developer resident portion and to form sharp and stable toner images on the photoconductor by development at a relatively small developer resident portion.

In addition, it is necessary to impart the electroconductivity to a developer since the electric charge is injected into the photoconductor through the developer. Therefore, when a developer to be employed is a one-component type developer, an electroconductive magnetic toner is essentially required. The toner image thus formed on the photoconductor cannot be transferred to a sheet of plain paper by the electrostatic image transfer method such as corona transfer or bias roller transfer. As a result, only a sheet of paper with high resistivity can be used in this system.

The method of forming a multi-colored image on a sheet of plain paper by the rear side exposure system is disclosed in Japanese Patent Publication 60-59592. In this method, however, since a photoconductor is prepared by overlaying an insulating layer on a photoconductive layer, the photoconductor cannot stand the repetition of formation of multicolored images thereon. To solve this problem, it is proposed that the residual latent image formed on the photoconductor be erased by application thereto of a transfer electrical field. This proposal is still insufficient in practice for obtaining clear images over an extended period of time.

As in the Journal of the Institute of Electrophotography Engineers of Japan vol. 27, No. 3, p.442 (1988) and Japanese Laid-Open Patent Application 61-46961, the image formation can be achieved by the rear side exposure and the simultaneous development system, with the application of a charging bias and a development bias to a photoconductor, having counter polarities, using a two-component type developer comprising iron carrier particles with a resistivity of $10^4$ to $10^8$ Ω.cm and magnetic toner particles with electrically insulating properties.

However, when the above-mentioned image formation method is applied to the practically-used copying apparatus, it is difficult to control the image formation system for obtaining a clear image over an extended period of time, and in addition, the structure of the apparatus necessarily becomes complicated.

Furthermore, there are disclosed a variety of image forming methods by use of a developer comprising a magnetic carrier prepared by dispersing a magnetic material in a binder resin. For example, a developer comprising the above-mentioned magnetic carrier and an electrically insulating non-magnetic toner is proposed in Japanese Laid-Open Patent Applications 53-33152 and 55-41450; and a developer comprising the above-mentioned magnetic carrier and an electrically insulating magnetic toner is proposed in Japanese Laid-Open Patent Applications 53-33152, 53-33633 and 53-35546. In these disclosures, the carrier component in a developer has insulating properties and the development is carried out by the conventional Carlson process.

In a two-component developer as disclosed in Japanese Laid-Open Patent Application 57-204570, two kinds of magnetic carriers are used in combination, with one magnetic carrier having higher electroconductivity and larger particle diameter as compared with the other magnetic carrier. Using such a two-component developer, development is carried out with a development bias voltage and a pulse voltage applied to a development sleeve. This image forming method is not based on the rear side exposure system, but the Carlson process.

The applicants of the present application have proposed an electroconductive magnetic resin carrier suitable for the rear side exposure system, which is prepared by forming an electroconductive layer on the surface of a base particle comprising a binder resin and a magnetic material dispersed in the binder resin, and an image forming method based on the rear side exposure system using the above-mentioned carrier, as disclosed in Japanese Laid-Open Patent Application 5-80591.

When a two-component developer comprising the above-mentioned electroconductive magnetic resin carrier and an electrically insulating toner is used to carry out the image formation on the basis of the rear side exposure system. In the image forming procedure by this method, a development bias voltage is applied to a development drum and electric charges are thus injected into a photoconductor through the electroconductive magnetic resin carrier, thereby charging the photoconductor to a predetermined polarity. In order to provide the photoconductor with the required charge quantity and carry out the image formation in a stable condition, therefore, it is necessary to decrease and stabilize the resistivity of the developer.

However, the resistivity of the above-mentioned electroconductive magnetic resin carrier is not always sufficiently low, and the resistivity of a developer comprising this type of electroconductive magnetic resin carrier is apt to increase due to deterioration of the developer during repeated operations for a long period of time. As a result, the surface of the photoconductor cannot be uniformly charged.

Furthermore, a coated-type carrier which is prepared by coating a base particle with a polyolefin resin is disclosed, for example, in Japanese Laid-Open Patent Applications 2-187770, 2-187771, 3-208060 and 4-70853. In these applications, the following descriptions are given:

(1) The synthetic resin layer can be formed on a base particle by polymerizing monomers directly on the surface of the base particle in accordance with the method described in Japanese Laid-Open Patent Application 60-106808.

(2) The surface of the resin-coated-type carrier particle thus obtained can be provided with convex and concave portions, with a shape factor of 130 to 200.

(3) The surface profile of the resin-coated-type carrier particles can be controlled by heat treatment after the formation of the synthetic resin layer on each base particle.

(4) The base particle for this resin-coated-type carrier may essentially consist of magnetic powder such as iron, ferrite or magnetite, or comprise a binder resin and finely-divided particles of a magnetic material dispersed in the binder resin.

(5) The synthetic resin layer provided on the base particle may further comprise finely-divided particles of an electroconductive material such as carbon black.

According to the aforementioned applications, the resistivity of the synthetic resin layer formed on the base carrier particle is preferably in the range of $1\times10^{6}$ to $1\times10^{14}\Omega$.cm, more preferably in the range of $10^{8}$ to $10^{13}$ $\Omega$.cm, and further preferably in the range of $10^{9}$ to $10^{12}\Omega$.cm. Further, it is said that the resistivity of the resin-coated-type carrier can appropriately be decreased by the addition of electroconductive finely-divided particles such as carbon black to the synthetic resin layer, and consequently an adequate balance is maintained between leakage of electric charges from the photoconductor and accumulation of electric charges thereon, and therefore, the development performance can be improved and images can be obtained with high image density and clear contrast. It is obvious from the above descriptions that this kind of coated-type carrier is oriented to an electrically insulating carrier for charging a toner, and it is not suggested that this coated-type carrier be used as an electroconductive carrier. In addition, image formation is carried out using commercially available copying machine based on the Carlson process in all of the above-mentioned applications, and there is no suggestion that the image formation be carried out on the basis of the rear side exposure system using this resin-coated-type carrier.

SUMMARY OF THE INVENTION

Accordingly, a first object of the present invention is to provide a developer with high electroconductivity, suitable for the image formation method based on the rear side exposure system, with the electroconductivity maintained at high level during the repeated operation over a long period of time.

A second object of the present invention is to provide an image formation method using the rear side exposure system, by which method the electric charge can be readily injected into a photoconductor, a latent electrostatic image can be satisfactorily developed with a developer, and the obtained toner image can be easily transferred to a sheet of an image-receiving medium.

The first object of the present invention can be achieved by a developer for developing latent electrostatic images to visible toner images for use in an image formation method of forming a toner image by developing a latent electrostatic image formed corresponding to a light image on a photoconductor by use of (i) a photoconductor which comprises a light-transmitting support, and at least a light-transmitting electroconductive layer and a photo-conductive layer which are successively overlaid on the light-transmitting support, (ii) development means which is disposed on the side of the photoconductive layer of the photoconductor and supplies the developer onto the surface of the photoconductor to develop a latent electrostatic image to a visible toner image, (iii) voltage application means for applying a voltage across the light-transmitting electroconductive layer of the photoconductor and the development means, and (iv) exposure means which is disposed on the side of the light-transmitting support of the photoconductor in such a configuration as to be directed toward the development means, comprising the steps of bringing the developer into contact with the surface of the photoconductor, and applying a light image to the photo-conductive layer located near a position where the light-transmitting support and the development means are mutually directed, from the side of the light-transmitting support, under the application of a voltage across the light-transmitting electroconductive layer and the development means; wherein the developer comprises (a) an electroconductive magnetic carrier comprising electroconductive magnetic carrier particles, each carrier particle comprising a magnetic base particle and an electroconductive layer formed on the surface of the magnetic base particle, (b) a magnetic high-resistivity carrier, and (c) an electrically insulating toner.

The second object of the present invention can be achieved by an image formation method of forming a toner image corresponding to a light image on a photoconductor obtained in accordance with the rear side exposure system by use of the above-mentioned developer.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
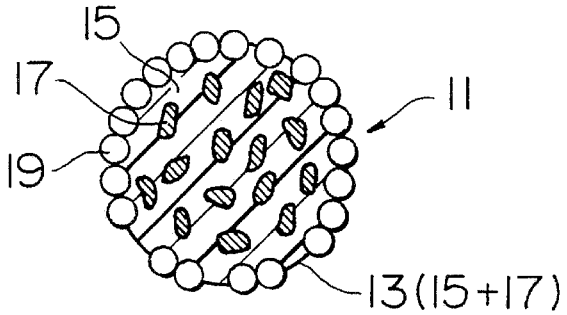
FIG. 1 is a schematic cross-sectional view of one embodiment of an electroconductive magnetic carrier particle used for a developer according to the present invention.

A developer according to the present invention comprises an electroconductive magnetic carrier, a magnetic high-resistivity carrier, and an electrically insulating toner.

The electroconductive magnetic carrier can be prepared by forming an electroconductive layer on the surface of a magnetic base particle to impart the electroconductivity thereto. For instance, the following two kinds of particles can be used as the magnetic base particles for the electroconductive magnetic carrier:

(1) Magnetic resin particles comprising a binder resin and finely-divided particles of a magnetic material dispersed and supported in the binder resin.

(2) Magnetic powder essentially consisting of finely-divided particles of a magnetic material such as ferrite or magnetite.

The specific gravity of the above-mentioned magnetic resin base particles (1) for the electroconductive magnetic carrier is relatively small, so that the amount of toner can be increased in the developer. Namely, the toner concentration (T/D) in the obtained developer can be increased, so that images with high image density can easily be obtained, and half-tone images can be faithfully reproduced.

When the magnetic powder (2) is used as the magnetic base particles for the electroconductive magnetic carrier, the fluidity of the obtained electroconductive magnetic carrier is excellent due to large specific gravity of the magnetic powder. Therefore, toner particles can sufficiently be stirred and mixed with the carrier particles in a development unit, and readily transported to the surface of a photoconductor. This makes it possible to reduce the stress applied to the developer which is disposed between the photoconductive drum and a development drum.

To impart the electroconductivity to the above-mentioned magnetic base particles, an electroconductive layer is provided on the surface of the magnetic base particles by the following methods:

(a) The electroconductive finely-divided particles are fixed on the surface of the magnetic base particles. This method, which is particularly suitable for the above-mentioned magnetic resin base particles (1), has the advantages that the productivity is excellent and the degree of electroconductivity imparted to the magnetic base particles can easily be determined and controlled.

(b) An electroconductive resin layer comprising a synthetic resin and electroconductive finely-divided particles dispersed in the synthetic resin is coated on the magnetic base particles. This method is applicable to both of the above-mentioned magnetic resin base particles (1) and magnetic powder (2). The durability of the electroconductive magnetic carrier prepared by this method is excellent, and the electroconductivity imparted to the magnetic base particles can be stabilized during the repeated operations over a long period of time.

(c) An electroconductive thin layer is formed on the surface of the magnetic base particles in such a manner that ITC (indium—tin oxide), indium oxide, tin oxide, aluminum, nickel, chromium or gold is deposited on the magnetic base particles in accordance with the conventional thin-layer forming methods such as CVD (chemical vapor deposition), vacuum deposition, or sputtering.

FIG. 1 is a schematic cross-sectional view of one embodiment of an electroconductive magnetic carrier for use in a developer according to the present invention.

In FIG. 1, an electroconductive magnetic carrier particle 11 comprises (i) a magnetic base particle 13 comprising a binder resin 15 and magnetic finely-divided particles 17 dispersed in the above-mentioned binder resin 15, and (ii) an electroconductive layer comprising electroconductive finely-divided particles 19 fixed on the surface of the magnetic base particle 13.

Examples of the binder resin 15 contained in the magnetic base particle 13 are polyolefin resins such as polyethylene, polypropylene, polyethylene—polypropylene copolymer and polybutylene; vinyl resins such as a polystyrene resin including styrene—acrylic copolymer; polyester resins; and nylon resins.

As the magnetic finely-divided particle 17 for use in the magnetic base particle 13 of the electroconductive magnetic carrier particle 11, a spinel ferrite such as magnetite or gamma-iron-oxide; a spinel ferrite comprising at least one metal, except iron, such as Mn, Ni, Mg or Cu; a magnetoplumbite-type ferrite such as barium ferrite; and finely-divided particles of iron or alloys thereof having a surface oxidized layer can be employed in the present invention. The shape of the magnetic particle 17 may be a granule, a sphere or a needle.

In the case where the electroconductive magnetic carrier particle 11 for use in the present invention is required to be highly magnetized, finely-divided particles of a strongly magnetic substance such as iron may be employed. It is preferable that finely-divided particles of the strongly magnetic substance such as the aforementioned spinel ferrite including magnetite and gamma-iron-oxide, and magnetoplumbite-type ferrite including barium ferrite be used as the magnetic particles 17 for use in the magnetic base particle 13, with the chemical stability taken into consideration. The base particle 13 for the electroconductive magnetic carrier can be provided with the desired magnetic force by appropriately selecting the kind of strongly magnetic substance and determining the amount thereof. It is proper that the amount of the magnetic finely-divided particles 17 be in the range of 70 to 90 wt. % of the total weight of the magnetic base particle 13. it is preferable that the particle diameter of the magnetic finely-divided particles 17 contained in the magnetic base particle 13 be in the range of about 0.1 to 1.0 μm.

To fix the electroconductive finely-divided particles 19 to the surface of the magnetic base particle 13, for example, the magnetic base particles 13 and the electroconductive finely-divided particles 19 are uniformly mixed in such a fashion that the electroconductive finely-divided particles 19 may adhere to the surface of each magnetic base particle 13. Subsequently, these electroconductive particles 19 are fixed on the magnetic base particle 13 with the application of mechanical or thermal shock thereto, so as not to completely embed the electroconductive particle 19 into the magnetic base particle 13, but to allow part of the electroconductive particle 19 to protrude over the magnetic base particle 13.

As previously described, the electroconductivity can efficiently be imparted to the carrier by forming the electroconductive layer on the magnetic base particle 13 in such a manner that the electroconductive finely-divided particles 19 are fixed on the surface of the magnetic base particle 13.

In the electroconductive magnetic carrier particle 11 as shown in FIG. 1, it is not always necessary to coat the overall surface of the magnetic base particle 13 with the electroconductive layer. Namely, an electroconductive part may be at least formed on the surface of the magnetic base particle 13 so long as the obtained carrier is provided with the sufficient electroconductivity. As shown in FIG. 1, therefore, the surface of the magnetic base particle 13 may be partially exposed without the electroconductive layer. In addition, the electroconductive finely-divided particles 19 are not fixed on the surface of the magnetic base particle 13 where the magnetic particle 17 protrudes over the magnetic base particle 13.

Examples of the electroconductive finely-divided particles 19 for use in the electroconductive layer include particles of carbon black, tin oxide, electroconductive titanium oxide which is prepared by coating an electroconductive material on titanium oxide, and silicon carbide. It is desirable that the electroconductive materials not losing its electroconductivity by oxidation in the air be used as the electroconductive finely-divided particles 19.

The apparatus for fixing the electroconductive finely-divided particles 19 on the surface of the magnetic base particle 13 is commercially available as a surface-modification apparatus or surface-modification system.

For example:

(1) dry-type mechanochemical method
"Mechanomill" (Trademark), made by Okada Seiko Co., Ltd.
"Mechanofusion System" (Trademark), made by Hosokawa Micron Corporation (2) high-velocity impact method
"Hybridization System" (Trademark), made by Nara Machinery Co., Ltd.
"Kryptron" (Trademark), made by Kawasaki Heavy Industries, Ltd.

(3) wet-method
"Dispercoat" (Trademark), made by Nisshin Flour Milling Co., Ltd.
"Coatmizer" (Trademark), made by Freund Industrial Co., Ltd.

(4) heat-treatment method
"Surfusing" (Trademark), made by Nippon Pneumatic Mfg. Co., Ltd.

(5) others
"Spray dry" (Trademark), made by Ohgawara Kakouki Co., Ltd.

It is proper that the average particle diameter of the electroconductive finely-divided particle 19 for use in the electroconductive magnetic carrier particle 11 be 1.0 μm or less, more preferably 0.1 μm or less.

Figure 2:
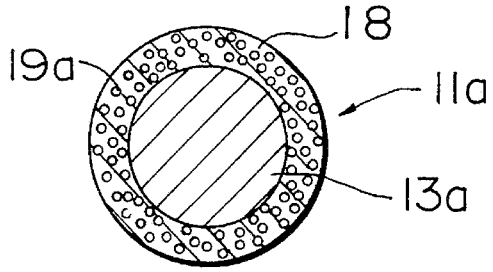
FIG. 2 is a schematic cross-sectional view of another embodiment of an electroconductive magnetic carrier particle used for a developer according to the present invention.

FIG. 2 is a schematic cross-sectional view of another embodiment of an electroconductive magnetic carrier for use in a developer according to the present invention.

In FIG. 2, an electroconductive magnetic carrier particle **11*a* comprises a magnetic base particle 13*a*, and an electroconductive resin layer 18 formed on the surface of the magnetic base particle 13*a***.

For the magnetic base particle **13*a***, the previously mentioned magnetic resin base particle comprising a synthetic resin and magnetic finely-divided particles dispersed and supported in the synthetic resin, or the magnetic powder essentially consisting of the finely-divided particles of a magnetic material can be employed.

When the magnetic powder is used for the magnetic base particle **13*a*, the same magnetic particles as those previously explained as the materials for the magnetic particles 17 in the embodiment of FIG. 1**, namely, ferrite, magnetite and iron can be employed. The magnetic particles may be spherical or amorphous.

The electroconductive resin layer 18 for use in the electroconductive magnetic carrier particle **11*a* comprises a synthetic resin and electroconductive finely-divided particles 19*a*** dispersed and supported in the synthetic resin.

Examples of the synthetic resin for use in the electroconductive resin layer 18 include polyolefin resins such as polyethylene; silicone resins and polyurethane resins. In particular, polyolefin resins such as polyethylene resin are preferred because the spent toner can be prevented from adhering to the surface of the electroconductive magnetic carrier particle, and the environmental resistance of the carrier particle can be improved.

Specific examples of the electroconductive finely-divided particles **19*a* for use in the electroconductive resin layer 18** include particles of carbon black, tin oxide, electroconductive titanium oxide which is prepared by coating an electroconductive material on titanium oxide, silicon carbide, and a variety of metals.

The amount of the electroconductive finely-divided particles **19*a* in the electroconductive resin layer 18, which varies depending on the electroconductivity-imparting capability of the employed electroconductive particles 19*a*, may be determined so as to impart the sufficient electroconductivity required forth the electroconductive magnetic carrier 11*a***. The degree of electroconductivity required for the electroconductive magnetic carrier, which is related to the resistivity thereof, will be described later.

The thickness of the electroconductive resin layer 18 may be determined depending on the wt. % of the magnetic base particle **13*a* of the total weight of the electroconductive magnetic carrier particle 11*a*. When the magnetic powder is used for the magnetic base particle 13*a*, it is preferable that the amount of the magnetic base particle 13*a* be 80 wt. % or more, and more preferably 85 wt. % or more, and further preferably in the range from 90 to 98 wt. %, of the total weight of the electroconductive magnetic carrier particle 11*a*. When the previously mentioned magnetic resin base particle is used for the magnetic base particle 13*a*, it is preferable that the amount of the magnetic base particle 13*a* be 80 wt. % or more, and more preferably in the range from 85 to 96 wt. %, of the total weight of the electroconductive magnetic carrier particle 11***a*. When the amount ratio of the magnetic base particle 13*a* is within the above range, the decrease in magnetic force of the electroconductive magnetic carrier particle 13*a* can be avoided, thereby preventing the attraction of the carrier particle 13*a* to the photoconductor together with the toner particle in the development process.

Furthermore, it is possible to provide the surface of the electroconductive magnetic carrier particle 11*a* with convex and concave portions. The amount of toner in the developer, that is, the toner concentration, can be increased to improve the image density when the convex and concave portions are appropriately provided on the surface of the electroconductive magnetic carrier particle 11*a*.

The surface profile of the electroconductive magnetic carrier particle 11*a* can be expressed by a shape factor (S) defined in the following formula:

$$S = \frac{(\text{Outer periphery})^2}{\text{Area}} \times \frac{1}{4\pi} \times 100$$

wherein the outer periphery represents an average value of the outer periphery of projected electroconductive magnetic carrier particles 11*a*; and the area represents an average value of the projected area of electroconductive magnetic carrier particles 11*a*.

In the above formula, the shape factor (S) of the electroconductive magnetic carrier particle 11*a* is preferably in the range of 130 to 200.

The method for preparing the electroconductive magnetic carrier particle 11*a* is not particularly limited, and for example, the following methods are applicable:

(1) A resin is dissolved in a solvent to prepare a resin solution, and electroconductive finely-divided particles are dispersed in the resin solution. The thus obtained resin solution is coated on the magnetic base particle 13*a* and the coated resin solution is heated to cause the solvent component therein to evaporate. Thus, an electroconductive resin layer 18 is formed on the surface of the magnetic base particle 13*a*.

(2) A resin is dissolved in a solvent to prepare a resin solution, and electroconductive finely-divided particles are dispersed in the resin solution. The thus obtained resin solution is coated on the magnetic base particle 13*a* and the coated resin solution is heated to cause the solvent component therein to evaporate, and accelerate the crosslinking and polymerization reactions of resin monomers in the coated resin solution. Thus, an electroconductive resin layer 18 is firmly fixed on the surface of the magnetic base particle 13*a*.

(3) Resin monomers for the electroconductive resin layer 18 are polymerized directly on the surface of the magnetic base particle 13*a* in the presence of electroconductive finely-divided particles 19*a*. Thus, an electroconductive resin layer 18 can be formed on the magnetic base particle 13*a* in such a fashion that the electroconductive finely-divided particles 19*a* become entangled in the resin.

The above-mentioned method (3) is described in detail in Japanese Laid-Open Patent Applications 2-187771 and 60-106808 referring to the coated-type carrier. According to this method (3), the electroconductive resin layer 18 can firmly be fixed on the magnetic base particle 13*a*. In addition to the above, the electroconductive finely-divided particles 19*a* are uniformly dispersed in the electroconductive resin layer 18 and scarcely removed from the electroconductive resin layer 18. Therefore, the electroconductive finely-divided particles 19*a* can be prevented from easily falling off from the electroconductive resin layer 18, and the electroconductive resin layer 18 itself can be prevented from being impaired in the course of stirring in a development unit, and consequently, the initial electroconductivity of the electroconductive magnetic carrier particle 11*a* can be maintained during the repeated operations.

Furthermore, the electroconductivity of the electroconductive magnetic carrier particle 11*a* shown in FIG. 2 does not deteriorate even if the electroconductive resin layer 18 is partially impaired.

Figure 3A:
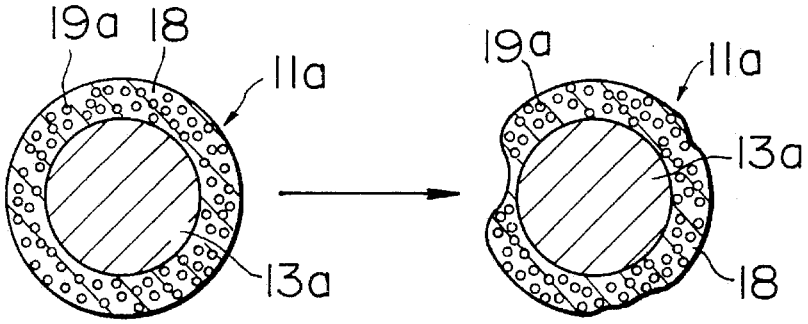
FIG. 3 includes cross-sectional views of two kinds of electroconductive magnetic carrier particles shown in FIGS. 1 and 2, in explanation of the durability of those electroconductive magnetic carrier particles.

As shown in FIG. 3(A), even though part of the electroconductive resin layer 18 of the electroconductive magnetic carrier particle 11*a* is abraded or impaired by the application of mechanical shock thereto in the course of stirring in the development unit during the repeated operations, the electroconductivity required for the electroconductive magnetic carrier particle 11*a* can be maintained so long as a part of the electroconductive resin layer 18 remains on the surface of the magnetic base particle 13*a*. Thus, electric charge can be injected into the photoconductor through a magnetic brush composed of the electroconductive magnetic carrier particles 11*a*.

Figure 3B:
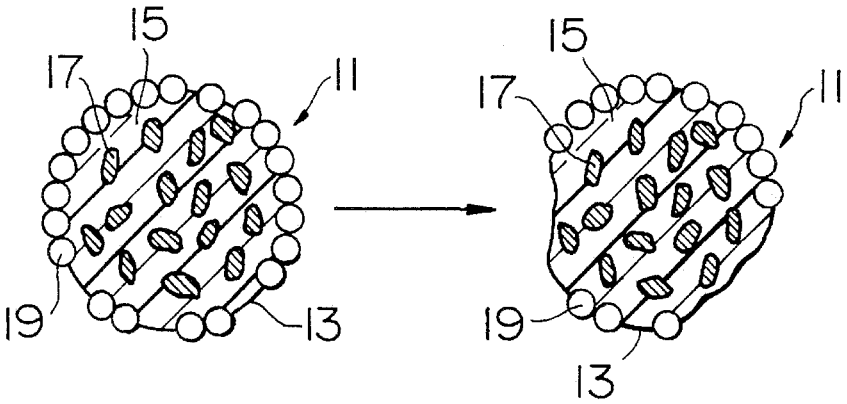

In the case of the electroconductive magnetic carrier particle 11 as shown in FIG. 1, in contrast to the above, only the electroconductive finely-divided particles 19 fixed on the magnetic base particle 13 serve as electroconductive sites. Therefore, when even a part of the surface of the electroconductive magnetic carrier particle 11 is damaged, as shown in FIG. 3(B), the electroconductivity of the carrier particle 11 immediately decreases or disappears.

It is preferable that the average particle diameter of the electroconductive magnetic carrier particles be in the range of 10 to 100 μ, more preferably in the range of 15 to 80 μm, and further preferably in the range of 20 to 70 μm.

The electroconductive magnetic carrier for use in the present invention is required to have a great magnetic force in some degree. It is preferable that the maximum magnetization (magnetic flux density) of the electroconductive magnetic carrier in a magnetic field of 5 kOe be 55 emu/g or more, more preferably in the range of 55 to 90 emu/g, and further preferably in the range of 60 to 85 emu/g. In a magnetic field of 1 kOe, the preferable maximum magnetization (magnetic flux density) of the electroconductive magnetic carrier is 40 emu/g or more, more preferably in the range from 40 to 90 emu/g, and further preferably 45 to 70 emu/g. When the magnetic force of the electroconductive magnetic carrier is within the above range, the electroconductive magnetic carrier can be prevented from being attracted to the photoconductor together with the toner particles.

It is preferable that the volume resistivity of the electroconductive magnetic carrier for use in the present invention be $10^6\Omega$.cm or less, more preferably $10^5\Omega$.cm or less, and further preferably in the range from $10^1$ to $10^4$ Ω.cm. When the volume resistivity of the electroconductive magnetic carrier is within the above range, the characteristics required for the electroconductive carrier are not impaired, so that the electric charge can readily be injected into the photoconductor and the photoconductor is sufficiently charged in the rear side exposure system.

To measure the volume resistivity of the electroconductive magnetic carrier, 1.5 g of electroconductive magnetic carrier particles are placed in a Teflon-made cylinder with an inner diameter of 20 mm, having an electrode at the bottom thereof, and the volume resistivity of the electroconductive magnetic carrier is measured when a counter electrode with an outer diameter of 20 mm is put on the carrier particles, with a load of 1 kg being applied to the top portion of the carrier particles.

In the developer according to the present invention, the aforementioned electroconductive magnetic carrier and a magnetic high-resistivity carrier are used in combination. By the addition of the magnetic high-resistivity carrier, the magnetic high-resistivity carrier particles and the electrically insulating toner particles are attracted to each other, thereby reducing the amount of electrically insulating toner particles gathering around the electroconductive magnetic carrier particles. Therefore, the electroconductive magnetic carrier particles readily come into contact with each other and electrically cling to each other. The resistivity of the thus obtained developer can be lowered. In other words, the electroconductivity of the developer can be increased.

It is preferable that the mixing ratio by weight of the electroconductive magnetic carrier to the magnetic high-resistivity carrier be in the range of (95:5) to (60:40), and more preferably in the range of (90:10) to (75:25). With the two kinds of carriers being mixed at the above-mentioned mixing ratio, the resistivity of the developer can sufficiently be decreased and stabilized.

For the magnetic high-resistivity carrier for use in the developer of the present invention, the following carrier particles can be employed:

(1) Non-coated type magnetic high-resistivity carrier particles essentially consisting of magnetic powder.

(2) Resin-coated-type magnetic high-resistivity carrier particles comprising magnetic powder and a resin coated on the magnetic powder, such as silicone resin, polyester resin, epoxy resin, fluororesin, acrylic resin, or styrene—acrylic copolymer resin.

(3) Magnetic resin high-resistivity carrier particles comprising a binder resin and magnetic finely-divided particles dispersed in the binder resin. This kind of carrier particle is equivalent to the magnetic base particle 13 of the electroconductive magnetic carrier particle 11 shown in FIG. 1.

Since the specific gravity of the above-mentioned magnetic high-resistivity carrier particles (1) and (2) is large, the stirring characteristics and the transporting characteristics of the toner particles can be improved when the magnetic high-resistivity carrier particles (1) or (2) is used together with the electroconductive magnetic carrier comprising a magnetic resin base particle with a relatively small specific gravity.

The performance of the magnetic high-resistivity carrier particles of non-coated type (1) is stable because there is no necessity of the peeling of a coated resin layer.

Since the resistivity of the resin-coated magnetic high-resistivity carrier particles (2) is so high that the resin-coated magnetic carrier particles (2) strongly cling to the electrically insulating toner particles, thereby reducing the resistivity of the developer. In addition, the resin-coated magnetic high-resistivity carrier particles (2) are excellent with respect to the charge-imparting characteristics to the toner.

When the magnetic resin high-resistivity carrier particles (3) are added to the electroconductive magnetic carrier particles which comprise magnetic base particles essentially consisting of magnetic powder with a large specific gravity, excellent charging and developing characteristics inherent in the magnetic resin high-resistivity carrier particles (3) can be imparted to the obtained developer.

As the magnetic finely-divided particles for use in the magnetic high-resistivity carrier particles (1), (2) and (3), the same magnetic particles as those employed in the electroconductive magnetic carrier, namely, ferrite, magnetite and iron can be employed.

It is preferable that the volume resistivity of the magnetic high-resistivity carrier for use in the present invention be $10^6\Omega$.cm or more, and more preferably $10^7\Omega$.cm or more.

It is preferable that the average particle diameter of the magnetic high-resistivity carrier be in the range of 30 to 100 μm, and more preferably in the range of 40 to 60 μm.

It is preferable that the maximum magnetization (magnetic flux density) of the magnetic high-resistivity carrier in a magnetic field of 5 kOe be 55 emu/g or more, more preferably in the range from 55 to 90 emu/g, and further preferably in the range from 60 to 85 emu/g. In a magnetic field of 1 kOe, the preferable maximum magnetization (magnetic flux density) of the magnetic high-resistivity carrier is 40 emu/g or more, more preferably in the range from 40 to 70 emu/g, and further preferably in the range from 45 to 60 emu/g.

When the average particle diameter and the magnetic force of the magnetic high-resistivity carrier are satisfied, the magnetic high-resistivity carrier can be prevented from being attracted to the photoconductor together with the toner particles.

Specific examples of the electroconductive magnetic carrier (a) and the magnetic high-resistivity carrier (b) are given as follows:

Group of electroconductive magnetic carrier (a)

($a_1$): electroconductive magnetic carrier comprising electroconductive magnetic carrier particles, each carrier particle comprising a magnetic base particle comprising a binder resin and finely-divided particles of a magnetic material dispersed and supported in the binder resin; and electroconductive finely-divided particles fixed on the surface of the magnetic base particle.

($a_2$): electroconductive magnetic carrier comprising electroconductive magnetic carrier particles, each carrier particle comprising a magnetic base particle comprising a binder resin and finely-divided particles of a magnetic material dispersed and supported in the binder resin; and an electroconductive resin layer coated on the magnetic base particle, comprising a synthetic resin and electroconductive finely-divided particles dispersed in the synthetic resin.

Group of magnetic high-resistivity carrier (b)

($b_1$): non-coated type magnetic high-resistivity carrier comprising magnetic carrier particles essentially consisting of magnetic powder.

($b_2$): resin-coated-type magnetic high-resistivity carrier comprising resin-coated magnetic carrier particles, each carrier particle comprising a magnetic powder and an electrically insulating resin coated on the magnetic powder.

($b_3$): magnetic resin high-resistivity carrier comprising magnetic resin carrier particles, each carrier particle comprising a binder resin and finely-divided particles of a magnetic material dispersed and supported in the binder resin.

For example, when the electroconductive magnetic carrier ($a_1$) is used in combination with the magnetic high-resistivity carrier ($b_1$), it is preferable that the mixing ratio by weight of the electroconductive magnetic carrier ($a_1$) to the magnetic high-resistivity carrier ($b_1$) be in the range from (95:5) to (60:40), and more preferably in the range from (90:10) to (80:20).

Table 1 shows the preferable mixing ratio by weight of the electroconductive magnetic carrier (a) to the magnetic high-resistivity carrier (b) in accordance with the combination of the two kinds of carriers.

TABLE 1

| | ($b_1$) | ($b_2$) | ($b_3$) |
|---|---|---|---|
| ($a_1$) | 95:5–60:40 [90:10–80:20] | 95:5–60:40 [90:10–80:20] | 95:5–70:30 [95:5–85:15] |
| ($a_2$) | 95:5–70:30 [93:7–85:15] | 95:5–70:30 [93:7–85:15] | 95:5–80:20 [95:5–90:10] |

In Table 1, the mixing ratio enclosed in brackets is more preferable.

The developer according to the present invention comprises the above-mentioned two kinds of carriers and an electrically insulating toner.

As the toner for use in the developer of the present invention, the conventional electrically insulating toner particles with a volume resistivity of $10^{14}\Omega$.cm or more, preferably $10^{15}\Omega$.cm or more can be employed. The volume resistivity of the toner can be measured by the same method as in the case of the carrier.

The toner for use in the present invention may comprise a binder resin, a coloring agent, a charge controlling agent and an off-set preventing agent. In addition, a magnetic toner can be prepared by the addition of a magnetic material, which is effective for improving the developing characteristics and preventing the scattering of toner particles in the image forming apparatus.

Examples of the binder resin for use in the toner are vinyl resins such as a polystyrene resin including styrene—acrylic copolymer; and polyester resins.

As the coloring agent for use in the toner, a variety of dyes and pigments such as carbon black can be used.

Examples of the charge controlling agent for use in the toner are quaternary ammonium compounds, nigrosine, bases of nigrosine, crystal violet and triphenylmethane compounds.

As the off-set preventing agent or image-fixing promoting assistant, olefin waxes such as low molecular weight polypropylene, low molecular weight polyethylene and modified materials of the above compounds can be employed in the present invention.

As the magnetic material for preparing the magnetic toner, magnetite and ferrite can be used.

It is preferable that the average particle diameter of the toner particle for use in the present invention be 20 μm or less, and more preferably in the range of 5 to 15 μm.

The volume resistivity of the developer according to the present invention, which can be measured by the same method as in the case of the carrier, is preferably $10^{6}\Omega$.cm or less, more preferably $10^{5}\Omega$.cm or less, further preferably in the range of $10^{2}$ to $10^{5}\Omega$.cm.

In the present invention, when the electroconductive magnetic carrier and the magnetic high-resistivity carrier are used in combination, they performs their own parts. More specifically, the electroconductive magnetic carrier mainly serves to form an electroconductive path, thereby injecting electric charges into the photoconductor by using a development bias voltage in order to uniformly charge the photoconductor to a predetermined polarity. On the other hand, the magnetic high-resistivity carrier serves to charge the toner particles.

In the case where the electroconductive magnetic carrier comprises a magnetic resin base particle as shown in FIG. 1, the transporting performance of the toner and the mixing characteristics with the toner particles are poor because of a small specific gravity of the electroconductive magnetic carrier. In such a case, the above-mentioned electroconductive magnetic carrier may be used in combination with the high-resistivity magnetic carrier of non-coated or resin-coated type which has a relatively large specific gravity. The developer thus obtained can be improved from the viewpoints of the transporting performance of the toner and the mixing performance of the carrier particles with the toner particles. In this case, the two kinds of carriers fulfill their own duties, and the magnetic high-resistivity carrier for use in the developer serves not only to charge the toner particles, but also to mix the toner particles and transport them to the development zone.

Furthermore, the electroconductive magnetic carrier is liable to deteriorate during the repeated operations. As a result, the resistivity of the developer is increased, causing the fogging and ghost images. By the addition of the magnetic high-resistivity carrier to the electroconductive magnetic carrier, however, the resistivity of the developer can be decreased and the decreased resistivity can be stabilized to prolong the life of the developer. Further, when the developer contains the electroconductive magnetic carrier comprising a magnetic base particle and an electroconductive resin layer, formed on the magnetic base particle, comprising a synthetic resin and electroconductive finely-divided particles dispersed in the synthetic resin, as shown in FIG. 2, the durability of the electroconductive magnetic carrier itself can be improved. Therefore, the life of the developer is further prolonged.

The reason for the decrease in resistivity of the developer by the addition of the magnetic high-resistivity carrier is supposed that the magnetic high-resistivity carrier particles and electrically insulating toner particles are electrostatically attracted to each other, and the amount of the toner particles gathering around the electroconductive magnetic carrier particles is decreased. Consequently, the probability of the electroconductive magnetic carrier particles coming into contact with each other becomes high. With the above-mentioned mechanism taken into consideration, it is desirable to increase the resistivity of the magnetic high-resistivity carrier for use in the present invention. Especially, resin-coated magnetic high-resistivity carrier is advantageous. The higher the resistivity of the magnetic high-resistivity carrier for use in the present invention, the stronger the attraction between the magnetic high-resistivity carrier particles and the electrically insulating toner particles. As a result, the electroconductivity required for the obtained developer can be ensured even though the amount of the electrically insulating toner is increased in the developer, so that the toner concentration can be increased, causing the increase in image density. Furthermore, since the carrier component comprises the magnetic high-resistivity carrier in the developer of the present invention, the charge quantity of toner becomes higher as compared with the case where a developer not comprising The magnetic high-resistivity carrier is employed even when the toner concentration is the same in the above two kinds of developers. As a result, the image density becomes high.

Even when the electroconductive layer formed on the surface of the magnetic base particle for use in the electroconductive magnetic carrier is partially impaired, it is not difficult to ensure the electroconductive path composed of the electroconductive magnetic carrier particles and stabilize the resistivity of the developer because there are few electrically insulating toner particles gathering around the electroconductive magnetic carrier particles.

In addition, the toner particles can be transported to the surface of the photoconductor owing to the electrostatic attraction to the magnetic high-resistivity carrier particles. Therefore, the transporting performance of the toner particles can be controlled without providing the toner with magnetic properties. This is advantageous in the preparation of a non-magnetic color toner and in the formation of colored images. In this case, the resin-coated magnetic high-resistivity powder carrier is preferable.

Figure 4:
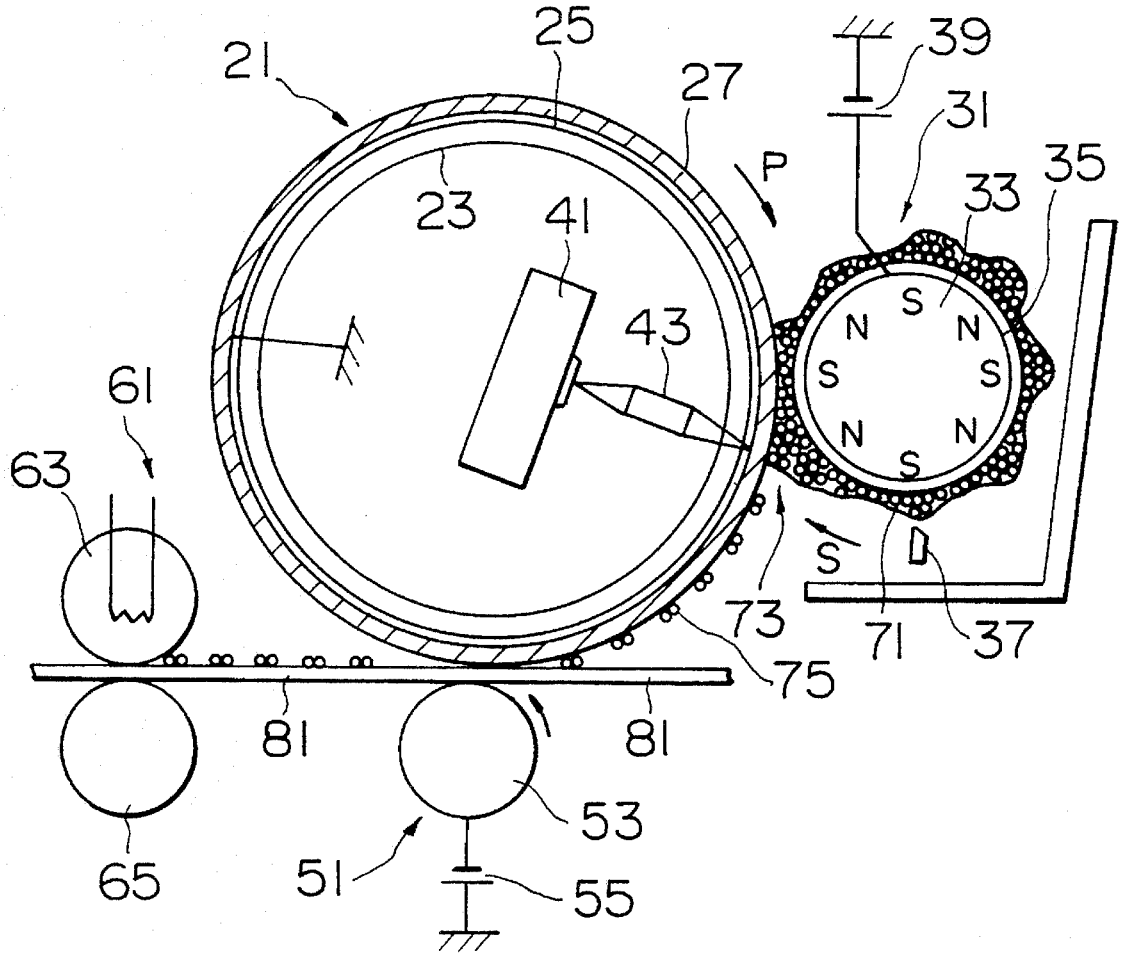
FIG. 4 is a diagram of an image forming apparatus in which the image formation method of the present invention is carried out.

FIG. 4 is a diagram of an image forming apparatus in which the image formation method of the present invention is carried out using the above-mentioned developer.

In FIG. 4, a drum photoconductor 21 comprises a hollow cylindrical light-transmitting support 23, for example, made of glass, a light-transmitting electroconductive layer 25 formed on the support 23, and an amorphous silicon (a-Si) based photoconductive layer 27 formed on the electroconductive layer 25. Instead of the drum photoconductor as shown in FIG. 4, a belt-shaped (sheet-shaped) photoconductor is available in the present invention.

Examples of the material for the photoconductive layer 27 include amorphous silicon (a-silicon), Se-alloys and organic materials. The materials of which sensitivity is high and in which the mobility of the electric charge carrier is high are preferred. With the above points taken into consideration, the amorphous-silicon based photoconductive layer is preferably employed. In particular, a photoconductor prepared by forming at least a light-transmitting electroconductive layer, an amorphous-silicon based photoconductive layer and a carrier-injection preventing top layer successively on a light-transmitting support is preferable.

As shown in FIG. 4, an LED array 41, serving as an exposure means (image signal exposing apparatus) is disposed inside the light-transmitting support 23 of the photoconductor 21 in such a configuration as to be directed toward a development unit 31, thereby conducting the rear side exposure through an optical transmitter 43 (Selfoc lens array). Instead of the LED array serving as the exposure means, an EL light emitting element array, a plasma light emitting element array, a fluorescent dot array, a shutter array obtained by combining a light source with liquid crystal or PLZT (lead (plomb) lanthanum zirconate titanate), and an optical fiber array can be employed in the present invention.

Around the photoconductor 21, there are situated the development unit 31, an image-transfer unit 51 and an image-fixing unit 61.

The development unit 31, which is disposed with facing the photoconductive layer 27 of the photoconductor 21, serves to supply the surface of the photoconductor 21 with a developer 71. An electroconductive sleeve 35 in the development unit 31 is connected to a development bias source 39 capable of applying a voltage across the light-transmitting electroconductive layer 25 of the photoconductor 21 and the development unit 31. In the development unit 31, a magnetic roller 33 having a plurality of magnetic poles (the N and S poles) is included in the electroconductive sleeve 35. The magnetic roller 33 may be fixed on the inside of the sleeve 35 or designed to be freely rotated therein.

The thickness of the developer 71 on the sleeve 35 is adjusted by a doctor blade 37. In the embodiment of the present invention, as shown in FIG. 4, the photoconductor 21 and the electroconductive sleeve 35 are respectively rotated in the directions of arrows P and S, and thus the developer 71 is transported to the surface of the photoconductor 21.

In the image formation procedure, as shown in FIG. 4, the developer 71 is transported from the sleeve 35 to the photoconductor 21 and accumulated at a developer resident portion 73, and the development bias voltage is applied from the development bias secure 39 to the electroconductive sleeve 35. When the photoconductive layer 27 of the photoconductor 21 is brought into contact with the developer 71, the electric charge from the development bias source 39 is injected into the photoconductive layer 27 through the magnetic brush composed of the electroconductive magnetic carrier particles contained in the developer 71. Thus, the residual electric charge remaining on the photoconductor 21 caused by the previous image formation process can be erased, and the surface of the photoconductor 21 can uniformly be charged. At the same time, the residual toner particles on the photoconductor 21, which have failed to be transferred to an image-receiving sheet 81 in the image-transfer unit 51, can be removed from the photoconductor 21 by the above-mentioned magnetic brush.

In the present invention, the electrically insulating toner particles can efficiently be charged by the magnetic high-resistivity carrier particles for use in the developer 71, and the transporting performance of the developer 71 can be improved. In addition, since the electrically insulating toner particles are electrostatically attracted to the magnetic high-resistivity carrier particles, the amount of toner particles gathering around the electroconductive magnetic carrier particles is reduced. As a result, the probability of the electroconductive magnetic carrier particles coming into contact with each other becomes high, so that the electroconductive magnetic carrier particles are continuously linked to form a stable electroconductive path securely.

As previously mentioned, the electroconductivity of the developer 71 of the present invention is sufficient and stable. Therefore, the photoconductor 21 can readily be charged in a stable condition. In addition, the following effects attendant on the advantage of the high and stable electroconductivity of the developer 71 can be obtained:

(1) The photoconductor 21 can be charged with the application of a low development bias voltage.

(2) The toner concentration in the developer can be set within a wide range.

(3) The number of revolutions of the sleeve 35 can be decreased, thereby prolonging the life of the carrier particles.

(4) The rotational speed of the photoconductor 21 can be increased, so that the high-speed image formation becomes possible.

According to the image formation method of the present invention, a light signal corresponding to the original image is applied to a position of the photoconductor 21, which is located downstream with respect to the position where the photoconductor 21 and the development means 31 are mutually directed, by use of the exposure means such as the LED array 41 which is disposed on the side of the light-transmitting support 23 of the photoconductor 21 in such a configuration as to be directed toward the development unit 31 via the photoconductor 21.

When the uniformly charged photoconductor 21 is selectively exposed to the light signal by use of the LED array 41, the potential at a light-exposed portion of the photoconductive layer 27 is rapidly decreased, thereby generating the potential difference on the photoconductive layer 27. Depending on the potential difference on the photoconductive layer 27, the toner particles attached to the magnetic brush are freed from the magnetic force or the electrostatic charge exerted thereon by the magnetic brush, separated therefrom, and then deposited to the surface of the photoconductive layer 27.

Even after the photoconductive layer 27 of the photoconductor 21 is separated from the developer in the developer resident portion 73 as the photoconductor 21 is rotated in the direction of the arrow P and the sleeve 35 is rotated in the direction of the arrow S, the above-mentioned toner particles attached to the photoconductive layer 27 remains as they are, so that a toner image 75 can be formed on the surface of the photoconductor 21. In such a development process, since the magnetic brush composed of the magnetic carrier particles is stable, the quantity of the developer in the developer resident portion 73 can be maintained. As a result, sharp and stable images can be obtained.

Since the exposure of the photoconductor 21 to the light signal is conducted at the above-mentioned position, the development bias voltage applied to the photoconductor 21 can sufficiently be stabilized by the time when the exposure process is started. Consequently, the surface of the photoconductor 21 can be uniformly charged regardless of the influence of the hysteresis exerted thereon, and the residual toner remaining on the surface of the photoconductor 21 can be satisfactorily recovered. In addition, since the photoconductor 21 is exposed to the light signal to generate the photocarriers after the development bias voltage applied to the photoconductor 21 is sufficiently stabilized, excellent toner images 75 can be formed on the photoconductor 21. Since the photoconductor 21 is speedily separated from the developer resident portion 73 after the formation of the toner images 75, the toner images 75 on the photoconductor 21 are not impaired by the application of mechanical shock such as the collision or friction between the toner images 75 and the developer 71. Thus, toner images 75 with excellent resolution can be obtained.

In the image formation method of the present invention, in which the charging, exposure and development are simultaneously carried out, it is preferable that the development bias voltage be as low as 250 V or less, more preferably in the range from 10 to 200 V, and further preferably in the range from 30 to 150 V.

In FIG. 4, the toiler image 75 formed on the photoconductor 21 is transferred to the image-receiving sheet 81 in the image-transfer unit 51 by using a transfer roller 53 to which a transfer bias voltage with a negative voltage is applied by a transfer bias source 55.

The toner for use in the present invention has the insulating properties, so that the toner image can be steadily transferred to the image-receiving sheet at high transfer efficiency even though the employed image-receiving sheet is a sheet of plain paper.

Then, in the image-fixing unit 61, the image-receiving sheet 81 carrying the toner image thereon is caused to pass through the gap between a heat-application roller 63 and a pressure-application roller 65 to fix the toner image to the image-receiving sheet 81.

After the image-transfer operation, the residual toner particles on the photoconductor 21 are removed therefrom in such a manner that the toner particles remaining on the photoconductor 21 are attracted to the magnetic brush composed of the electroconductive magnetic carrier particles when the photoconductor 21 reaches the position where the photoconductor 21 is directed toward the development unit 31 and brought into contact with the developer 71. This mechanism necessitates no cleaning member. As a matter of course, a cleaning unit may be provided for the step prior to development in the development unit 31 in the present invention.

In addition, a quenching means, for example, a quenching light, capable of erasing the residual charge on the photoconductive layer 27 of the photoconductor 21 may be provided between the image-transfer unit 51 and the development unit 31.

As previously explained, the developer according to the present invention can be adapted to the rear side exposure system. The developer according to the present invention can also be applied to various kinds of image formation methods which require a developer with high electroconductivity and magnetic properties.

According to the present invention, the photoconductor can efficiently be charged in a stable condition over a long period of time in the image formation on the basis of the rear side exposure system because the electroconductivity of the developer is remarkably improved. In addition, the life of the developer itself can be prolonged.

Other features of this invention will become apparent in the course of the following description of exemplary embodiments which are given for illustration of the invention and are not intended to be limiting thereof.

Example 1

Preparation of Electroconductive Magnetic Carrier

A mixture of the following components was kneaded and pulverized in a jet-mill, and then classified to obtain magnetic base particles for use in an electroconductive magnetic carrier:

| | Parts by Weight |
|---|---|
| Styrene/n-butyl acrylate copolymer (80:20) | 25 |
| Magnetite | 75 |

100 parts by weight of the above obtained magnetic base particles and 2 parts by weight of electroconductive carbon black particles with an average particle diameter of to 30 nm were thoroughly mixed in a Henschel mixer, so that the electroconductive carbon black particles were uniformly attached to the surface of the magnetic base particles.

Then, the carbon black particles were fixed on the surface of the magnetic base particles by the application of mechanical shock thereto using a commercially available surface modification apparatus "Hybridization System" (Trademark), made by Nara Machinery Co., Ltd. Thus, an electroconductive magnetic carrier for use in the present invention was prepared.

The characteristics of the above-prepared electroconductive magnetic carrier were as follows:

Volume resistivity: $2\times10^3\Omega$.cm

Maximum magnetization: 73 emu/g

Average particle diameter : 33 μm

Preparation of Magnetic High-resistivity Carrier

Non-coated type magnetic high-resistivity powder carrier consisting of ferrite particles was prepared.

The characteristics of the above-prepared magnetic high-resistivity carrier were as follows:

Volume resistivity: $5\times10^7\Omega$.cm

Maximum magnetization: 70 emu/g

Average particle diameter: 50 μm.

Preparation of Toner

A mixture of the following components was kneaded and pulverized in a jet-mill, and then classified to obtain toner particles with an average particle diameter of 7 μm:

| | Parts by Weight |
|---|---|
| Styrene/n-butyl acrylate copolymer (80:20) | 73 |
| Magnetite | 15 |
| Carbon black | 5 |
| Polypropylene wax | 5 |
| Charge-controlling agent | 2 |

Preparation of Developer

The above prepared electroconductive magnetic carrier and electrically insulating toner were mixed with a mixing ratio by weight of 83 to 17. To this mixture, the magnetic high-resistivity carrier was added, with the amount ratio thereof changed in the range from 0 to 40 wt. % of the total weight of the developer, and the resistivity of each developer thus obtained was measured. Using the developers comprising the magnetic high-resistivity carrier in different amounts, image formation was carried out by the image forming apparatus as shown in FIG. 4. The image density of the obtained image was measured.

Figure 5:
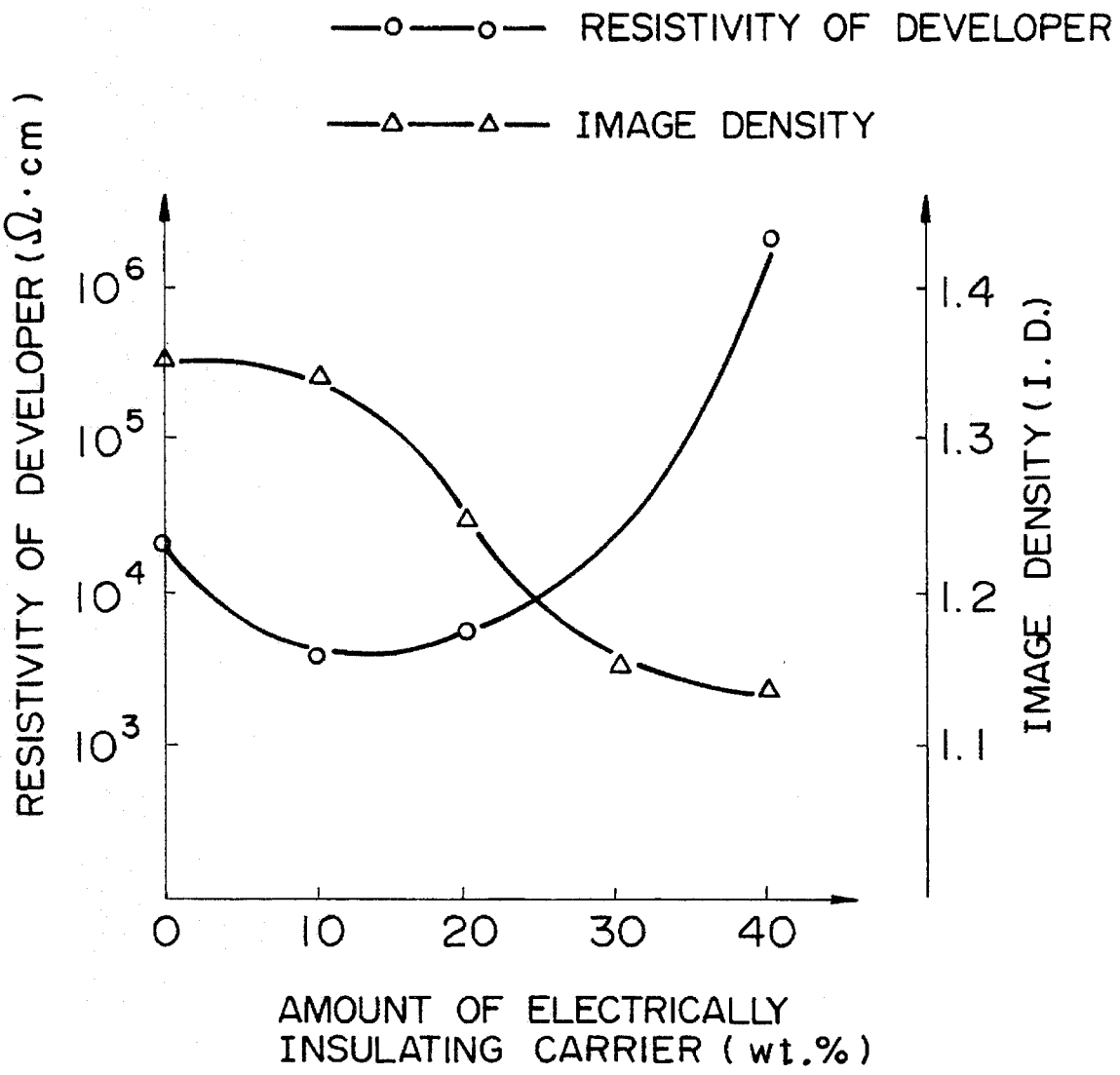
FIG. 5 is a graph showing the relationship among the amount of a magnetic high-resistivity carrier (namely, an electrically insulating carrier), the resistivity of a developer, and the image density of obtained images in Example 1.

FIG. 5 shows the relationship among the amount ratio of the magnetic high-resistivity carrier, that is, electrically insulating carrier, the resistivity of the obtained developer, and the image density of the obtained image.

As is apparent from the graph shown in FIG. 5, the resistivity of the developer decreases with the increase in the amount ratio of the magnetic high-resistivity carrier in the first step. This is because the magnetic high-resistivity carrier particles and the electrically insulating toner particles are electrostatically attracted to each other, and the amount of the toner particles gathering around the electroconductive magnetic carrier particles is decreased, thereby forming an electroconductive path by the electroconductive magnetic carrier particles. When the amount of the magnetic high-resistivity carrier exceeds 20 wt. % of the total weight of the developer, the amount of electrically insulating materials increases in the developer, so that the resistivity of the developer increases.

In the case where the amount of the electrically insulating toner was increased instead of the magnetic high-resistivity carrier, the fogging and ghost images were observed all over the obtained images even by the addition of the toner in an amount of 10 wt. % of the total weight of the developer.

The image density gradually decreases with the increase of the magnetic high-resistivity carrier in the developer as can be seen in the graph shown in FIG. 5. This is because the toner concentration in the developer relatively decreases with the increase in the amount of the magnetic high-resistivity carrier. The deterioration in image density can be prevented by the addition of the electrically insulating toner depending upon the amount of the magnetic high-resistivity carrier.

Formation of Images

A developer of the present invention (A) and a comparative developer (B) with the following formulations given in Table 2 were prepared:

TABLE 2

| | Formulation for Developer (parts by weight) | | |
|---|---|---|---|
| | Electroconductive magnetic carrier | Magnetic high-resistivity carrier | Electrically insulating toner |
| Developer (A) | 83 | 10 | 17 |
| Developer (B) | 83 | 0 | 17 |

Each of the developer (A) of the present invention and the comparative developer (B) was supplied to the image forming apparatus, as shown in FIG. 4, comprising an a-silicon based photoconductor with an outer diameter of 30 mm, and the image formation test was carried out.

The voltage of +50 V was applied to a sleeve of a development unit by a development bias source 39. With the application of a transfer bias voltage of −200 V to a transfer roller 53, the toner images were transferred to a sheet of commercially available plain paper in a transfer unit.

The resistivity of each developer was measured at the initial stage of the image formation test and after the making of a print on 150,000 sheets. In addition, the images after making of a print on 150,000 sheets were evaluated. The results are given in Table 3.

TABLE 3

| | Resistivity (Ω · cm) | | Occurrence of Ghost Images |
|---|---|---|---|
| | At initial stage | After making of print on 150,000 sheets | (After making of print on 150,000 sheets) |
| Developer (A) | $5 \times 10^3$ | $1 \times 10^4$ | Nil |
| Developer (B) | $3 \times 10^4$ | $5 \times 10^5$ | Observed |

As can be seen from the results in Table 3, the developer (A) of the present invention scarcely deteriorated after the making of continuous print.

Furthermore, the above prepared electroconductive magnetic carrier was caused to deteriorate by stirring in a development unit. The electroconductive magnetic carrier subjected to deterioration and the above prepared electrically insulating toner were mixed to prepare a comparative developer (C) with a toner concentration of 15%.

The comparative developer (C) was supplied to the same image forming apparatus as previously employed to carry out the image formation. As a result, the fogging and ghost images were observed all over the obtained images.

By adding 10 parts by weight of the above prepared magnetic high-resistivity carrier to 90 parts by weight of the comparative developer (C), a developer of the present invention (D) was prepared. When the image formation was carried out using the developer (D) of the present invention in the same manner as previously mentioned, excellent images without the fogging and ghost image were obtained.

It was confirmed by this comparative test that the electrically insulating toner particles were transported in company with the magnetic high-resistivity carrier particles, and therefore the amount of toner particles gathering around the electroconductive magnetic carrier particles was decreased, thereby forming a stable electroconductive path.

EXAMPLE 2

Preparation of Magnetic High-resistivity Carrier

Resin-coated type magnetic high-resistivity powder carrier was prepared by coating ferrite particles with a silicone resin.

The characteristics of the above-prepared magnetic high-resistivity carrier were as follows:

Volume resistivity: $1\times10^{10}\Omega$.cm

Maximum magnetization: 68 emu/g

Average particle diameter: 52 μm

Preparation of Developer

The same electroconductive magnetic carrier and electrically insulating toner as those used in Example 1 were mixed with a mixing ratio by weight of 86 to 14. To this mixture, the above prepared resin-coated type magnetic high-resistivity carrier was added, with the amount ratio thereof changed in the range from 0 to 40 wt. % of the total weight of the developer, and the resistivity of each developer thus obtained was measured. Using the developers comprising the resin-coated magnetic high-resistivity carrier in different amounts, image formation was carried out by the image forming apparatus as shown in FIG. 4. The image density of the obtained image was measured.

Figure 6:
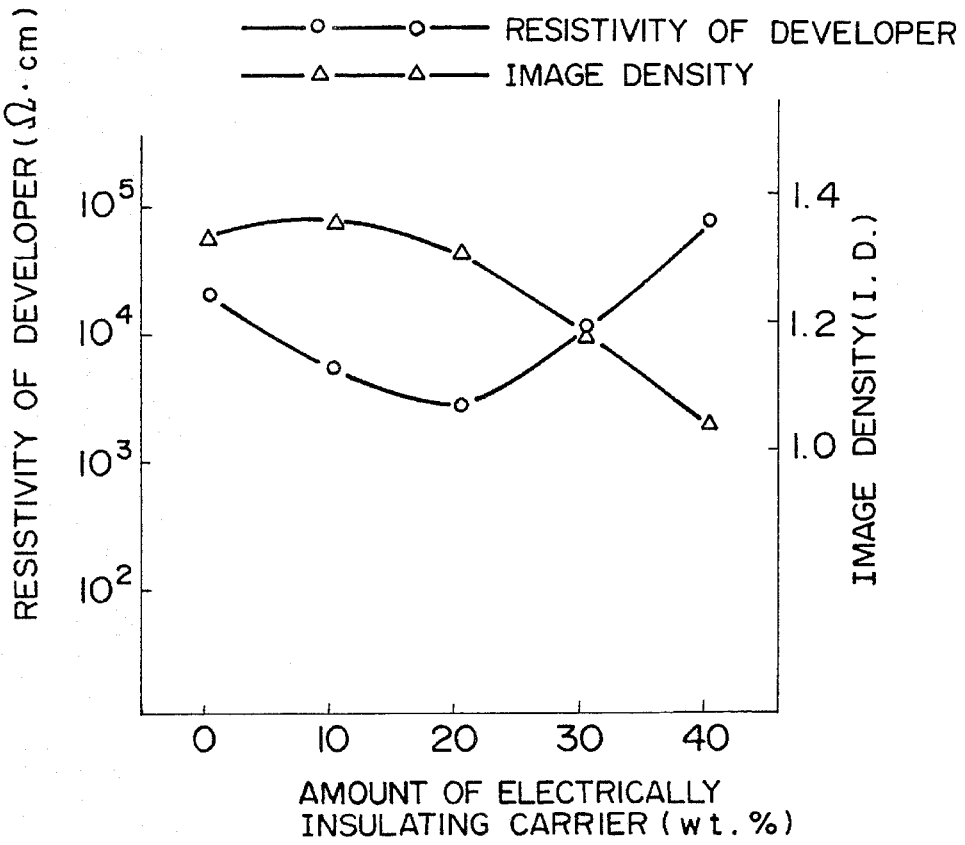
FIG. 6 is a graph snowing the relationship among the amount of a magnetic high-resistivity carrier (namely, an electrically insulating carrier), the resistivity of a developer, and the image density of obtained images in Example 2.

FIG. 6 shows the relationship among the amount ratio of the resin-coated magnetic high-resistivity carrier, that is, electrically insulating carrier, the resistivity of the obtained developer, and the image density of the obtained image.

As is apparent from the graph shown in FIG. 6, the resistivity of the developer decreases with the increase in the amount ratio of the magnetic high-resistivity carrier in the first step. This is because the resin-coated magnetic high-resistivity carrier particles and the electrically insulating toner particles are electrostatically attracted to each other, and the amount of the toner particles gathering around the electroconductive magnetic carrier particles is decreased, thereby forming an electroconductive path by the electroconductive magnetic carrier particles. When the amount ratio of the magnetic high-resistivity carrier further increases, the total weight of electrically insulating materials increases in the developer, so that the resistivity of the developer increases.

The resin-coated-type magnetic high-resistivity carrier was employed in this case, so that the amount ratio of the magnetic high-resistivity carrier in the developer can be increased as compared with the case where the non-coated type magnetic high-resistivity carrier was employed. As a result, the charge quantity of toner can be increased, thereby improving the image density.

The image density considerably decreases with the increase in the amount ratio of the magnetic high-resistivity carrier as can be seen from the graph in FIG. 6. This is because the toner concentration in the developer relatively decreases with the increase in the magnetic high-resistivity carrier. More specifically, the toner concentration is 14% when no magnetic high-resistivity carrier is added to the developer. With the addition of the magnetic high-resistivity carrier, the toner concentration in the developer gradually decreases, and the toner concentration reaches as low as 10% when the magnetic high-resistivity carrier was contained in the developer in an amount of 40 wt. % of the total weight of the developer.

Figure 7:
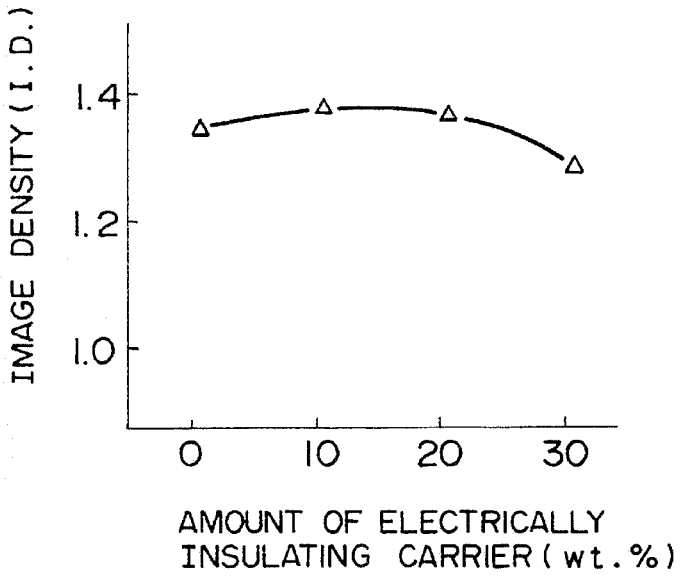
FIG. 7 is a graph showing the relationship between the amount of a magnetic high-resistivity carrier (namely, an electrically insulating carrier) and the image density of obtained images in Example 2.

Then, the amount of toner was increased along with the addition of the magnetic high-resistivity carrier so as to maintain the toner concentration at 14%, and the change in image density with the addition of the magnetic high-resistivity carrier was observed. The results are Shown in FIG. 7. As is apparent from the graph shown in FIG. 7, the image density is about the same even though the amount ratio of the magnetic high-resistivity carrier increases.

Formation of Images

A developer of the present invention (E) with the following formulation was prepared:

(Formulation for Developer E)

| | Parts by Weight |
|---|---|
| Electroconductive magnetic carrier (the same as in Example 1) | 86 |
| Magnetic high-resistivity carrier | 14 |
| Electrically insulating toner (the same as in Example 1) | 20 |

The above prepared developer (E) of the present invention was supplied to the same image forming apparatus as used in Example 1, and the image formation test was carried out.

The resistivity of the developer (E) was measured at the initial stage of the image formation test and after the making of a print on 150,000 sheets. In addition, the images after making of a print on 150,000 sheets were evaluated. The results are given in Table 4.

EXAMPLE 3

Preparation of Magnetic High-resistivity Carrier

A mixture of the following components was kneaded and pulverized in a jet-mill, and then classified to obtain magnetic resin high-resistivity carrier particles:

| | Parts by Weight |
|---|---|
| Styrene/n-butyl acrylate copolymer (80:20) | 25 |
| Magnetite | 75 |

Thus, a magnetic resin high-resistivity carrier for use in the present invention was prepared.

The characteristics of the above-prepared magnetic resin high-resistivity carrier were as follows:

Volume resistivity: $1\times10^{10}\Omega$.cm

Maximum magnetization: 72 emu/g

Average particle diameter: 45 μm

Preparation of Developer

The same electroconductive magnetic carrier and electrically insulating toner as used those in Example 1 were mixed with a mixing ratio by weight of 86 to 14. To this mixture, the above prepared magnetic resin high-resistivity carrier was added, with the amount ratio thereof changed in the range from 0 to 40 wt. % of the total weight of the developer, and the resistivity of each developer thus obtained was measured. Using the developers comprising the magnetic resin high-resistivity carrier in different amounts, image formation was carried out by the image forming apparatus as shown in FIG. 4. The image density of the obtained image was measured.

Figure 8:
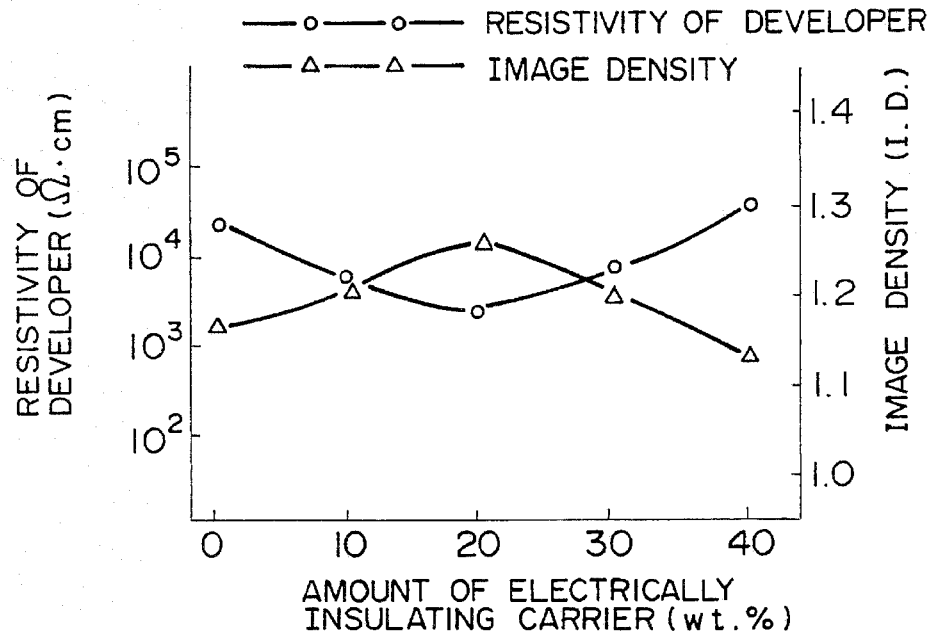
FIG. 8 is a graph showing the relationship among the amount of a magnetic high-resistivity carrier (namely, an electrically insulating carrier), the resistivity of a developer, and the image density of obtained images in Example 3.

FIG. 8 shows the relationship among the amount ratio of the magnetic resin nigh-resistivity carrier, that is, electrically insulating carrier, the resistivity of the obtained developer, and the image density of the obtained image.

As is apparent from the graph shown in FIG. 8, the resistivity of the developer decreases with the increase in the amount ratio of the magnetic resin high-resistivity carrier until the amount of the magnetic resin high-resistivity carrier becomes 20 wt. %. With the decrease in resistivity of the developer, the image density increases.

Formation of Images

A developer of the present invention (F) with the following formulation was prepared:

| | Parts by Weight |
|---|---|
| Electroconductive magnetic carrier (the same as in Example 1) | 86 |
| Magnetic resin high-resistivity carrier | 14 |
| Electrically insulating toner (the same as in Example 1) | 20 |

The above prepared developer (F) of the present invention was supplied to the sane image formation apparatus as used in Example 1, and the image forming test was carried out.

The resistivity of the developer (F) was measured at the initial stage and after the making of a print on 150,000 sheets. In addition, the images after making of a print on 150,000 sheets were evaluated. The results are given in Table 4.

EXAMPLE 4

Preparation of Electroconductive Magnetic Carrier

In accordance with the method as described in the Preparation Example 2 of Carrier in Japanese Laid-Open Patent Application 2-187771, an electroconductive magnetic carrier for use in the present invention was prepared using ferrite ($Fe_2O_3$—CuO—ZnO) with an average particle diameter of 30 μm. The ratio by weight of ferrite to a carbon-black-containing polyethylene resin layer for use in the electroconductive magnetic carrier particle was 94:6.

The characteristics of the above-prepared electroconductive magnetic carrier were as follows:

Volume resistivity: $5\times10^2\Omega$.cm

Maximum magnetization (in a magnetic field of 1 kOe): 55 emu/g

Average particle diameter: 35 μm

Preparation of Developer

The above prepared electroconductive magnetic carrier and the same electrically insulating toner as that used in Example 1 were mixed with a mixing ratio by weight of 92 to 8. To this mixture, the same magnetic resin high-resistivity carrier as that used in Example 3 was added, with the amount ratio thereof changed in the range from 0 to 40 wt. % of the total weight of the developer, and the resistivity of each developer thus obtained was measured. Using the developers comprising the magnetic resin high-resistivity carrier in different amounts, image formation was carried out by the image forming apparatus as shown in FIG. 4. The image density of the obtained image was measured.

Figure 9:
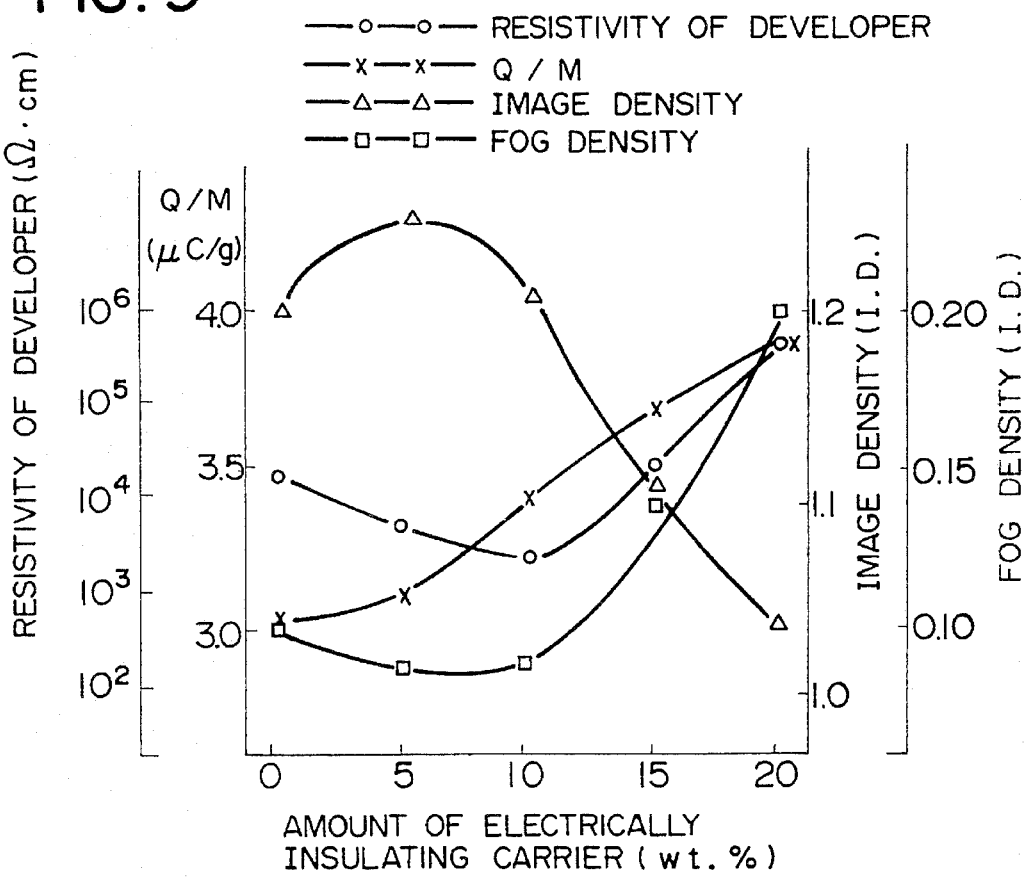
FIG. 9 is a graph showing the relationship among the amount of a magnetic high-resistivity carrier (namely, an electrically insulating carrier), the resistivity of a developer, the charge quantity of toner, the image density of obtained images, and the fog density in Example 4.

FIG. 9 shows the relationship among the amount ratio of the magnetic resin high-resistivity carrier, that is, electrically insulating carrier, the resistivity of the obtained developer, the image density of the obtained image, the fog density, and the charge quantity of toner.

As is apparent from the graph shown in FIG. 9, while the amount ratio of the magnetic resin high-resistivity carrier is increased to 10 wt. % of the total weight of the developer, the resistivity of the developer decreases and the fog density decreases, and the image density increases up to 1.20.

The charge quantity of toner (Q/M) increases with the addition of the magnetic resin high-resistivity carrier. This proves that the magnetic resin high-resistivity carrier serves to impart the electric charge to toner.

Formation of Images

A developer of the present invention (G) with the following formulation was prepared:

(Formulation for Developer G)

| | Parts by Weight |
|---|---|
| Electroconductive magnetic carrier | 92 |
| Magnetic resin high-resistivity carrier (the same as in Example 3) | 5 |
| Electrically insulating toner (the same as in Example 1) | 8 |

The above prepared developer (G) of the present invention was supplied to the same image forming apparatus as used in Example 1, and the image formation test was carried out.

The resistivity of the developer (G) was measured at the initial stage of the image formation test and after the making of a print on 150,000 sheets. In addition, the images after making of a print on 150,000 sheets were evaluated. The results are given in Table 4.

TABLE 4

| | Resistivity (Ω · cm) | | Occurrence of Ghost Images |
|---|---|---|---|
| | At initial stage | After making of print on 150,000 sheets | (After making of print on 150,000 sheets) |
| Developer (E) | $6\times10^3$ | $1\times10^4$ | Nil |
| Developer (F) | $3\times10^3$ | $2\times10^4$ | Nil |
| Developer (G) | $3\times10^3$ | $1\times10^4$ | Nil |

As can be seen from the results in Table 4, the developers (E), (F) and (G) of the present invention scarcely deteriorate after the making of continuous print.

What is claimed is:

1. A developer for developing visible toner images from latent electrostatic images for use in an image formation system for forming a toner image by developing a latent electrostatic image formed corresponding to a light image on a photoconductor, the system comprising:

(i) a photoconductor comprising a light transmitting support and at least a light-transmitting electroconductive layer and a photoconductive layer successively overlaid on the light-transmitting support, (ii) development means disposed substantially adjacent the photoconductive layer for supplying the developer onto the surface of the photoconductor to thereby develop a visible toner image from a latent electrostatic image, (iii) voltage application means for applying a voltage across the light-transmitting electroconductive layer and the development means, and (iv) exposure means disposed substantially adjacent the light-transmitting support and directed toward the development means, whereby the developer is brought into contact with the surface of the photoconductor, the developer comprising:

(a) an electroconductive magnetic carrier comprising a plurality of electroconductive magnetic carrier particles, each of the plurality of carrier particles comprising a magnetic base particle and an electroconductive layer formed on the surface of the magnetic base particle, the plurality of electroconductive magnetic carrier particles forming a magnetic brush for imparting an electric charge to the photoconductive layer when the developer is brought into contact with the photoconductor to thereby uniformly charge the surface of the photoconductor and erase any residual electric charge on the surface of photoconductor, (b) a magnetic high-resistivity carrier, and (c) an electrically insulating toner.

2. A developer for developing visible toner images from latent electronic images for use in an image formation system for forming a toner image by developing a latent electrostatic image formed corresponding to a light image on a photoconductor, the system comprising:

(i) a photoconductor comprising a light transmitting support and at least a light-transmitting electroconductive layer and a photoconductive layer sucessively overlaid on the light-transmitting support, (ii) developement means disposed substantially adjacent the photoconductive layer for supplying the developer onto the surface of the photoconductor to thereby develop a visible toner image from a latent electrostatic image, (iii) voltage application means for applying a voltage across the light-transmitting electroconductive layer and the development means, and (iv) exposure means disposed substantially adjacent the light-transmitting support and directed toward the development means, whereby the developer is brought into contact with the surface of the photoconductor, the developer comprising:

(a) an electroconductive magnetic carrier comprising a plurality of electroconductive magnetic carrier particles, each of the plurality carrier particles comprising a magnetic base particle and an electroconductive layer formed on the surface or the magnetic base particle, the plurality of electroconductive and electric charge to the photoconductive layer when the developer is brought into contact with the photoconductor to thereby uniformly charge the surface of the photoconductor and erase any residual electric charge on the surface of photoconductor, (b) a magnetic high-resistivity carrier, and (c) an electrically insulating toner, wherein the magnetic base particle comprises a binder resin and a plurality of finely-divided particles of magnetic material dispersed and supported in the binder resin, the electroconductive layer comprises a plurality of electroconductive finely-divided particles fixed on the surface of the magnetic base particle, and the magnetic high-resistivity carrier consists essentially of magnetic powder.

3. The developer of claim 1, wherein the magnetic base particle comprises a binder resin and a plurality of finely-divided particles of a magnetic material dispersed and supported in the binder resin, the eletroconductive layer comprises a plurality of electroconductive finely-divided particles fixed on the surface of the magnetic base particle, and the magnetic high-resistivity carrier comprises a plurality of carrier particles, each of the plurality of carrier particles comprising a magnetic particle and an electrically insulating resin coated on the magnetic particle.

4. The developer of claim 1, wherein the magnetic base particle comprises a binder resin and a plurality of finely-divided particles of a magnetic material dispersed and supported in the binder resin, the electroconductive layer comprises a plurality of electroconductive finely-divided particles fixed on the surface of the magnetic base particle, and the magnetic high-resistivity carrier comprises a plurality of carrier particles, each of the plurality of carrier particles comprising a binder resin and a plurality of finely-divided particles of a magnetic material dispersed and supported in the binder resin.

5. A developer for developing visible toner images from latent electrostatic images for use in an image formation system for forming a toner image by developing a latent electrostatic image formed corresponding to a light image on a photoconductor, the system comprising:

(i) a photoconductor comprising a light transmitting support and at least a light-transmitting electroconductive layer and a photoconductive layer successively overlaid on the light-transmitting support, (ii) development means disposed substantially adjacent the photoconductive layer for supplying the developer onto the surface of the photoconductor to thereby develop a visible toner image from a latent electrostatic image, (iii) voltage application means for applying a voltage across the light-transmitting electroconductive layer and the development means, and (iv) exposure means disposed substantially adjacent the light-transmitting support and directed toward the development means, whereby the developer is brought into contact with the surface of the photoconductor, the developer comprising:

(a) an electroconductive magnetic carrier comprising a plurality of electroconductive magnetic carrier particles, each of the plurality of carrier particles comprising a magnetic base particle and an electroconductive layer formed on the surface of the magnetic base particles, the plurality of electroconductive magnetic carrier particles comprising a magnetic brush for imparting an electric charge to the photoconductive layer when the developer is brought into contact with the photoconductor to thereby uniformly charge the surface the photoconductor and erase any residual electric charge on the surface of photoconductor, (b) a magnetic high-resistivity carrier, and (c) an electrically insulating toner, wherein the electroconductive layer comprises a synthetic resin and electroconductive finely-divided particles dispersed in the synthetic resin, and the magnetic high-resistivity carrier consists essentially of magnetic powder.

6. The developer of claim 1, wherein the electromagnetic-layer for use in the electromagnetic carrier particle comprises a synthetic resin and eletroconductive finely-divided particles dispersed in the synthetic resin, and the magnetic high-resistivity carrier comprises a plurality carrier particles, each of the plurality of carrier particles comprising a magnetic particle and an electrically insulating resin coated on the magnetic particle.

7. The developer of claim 1, wherein the eletroconductive layer for use in the electroconductive magnetic carrier particle comprises a synthetic resin and electroconductive finely-divided particles dispersed in the synthetic resin, and the magnetic high-resistivity carrier comprises a plurality of carrier particles, each of the plurality of carrier particles comprising a binder resin and finely-divided particles of a magnetic material dispersed and supported in the binder resin.

8. The developer of claim 1, wherein the electroconductive magnetic carrier has a volume resistivity of not greater than $10^6$ Ω.cm.

9. A developer for developing visible toner images from latent electrostatic images for use in an image formation system for forming a toner image by developing a latent electrostatic formed corresponding to a light image on a photoconductor the system comprising:

(i) a photoconductor comprising a light transmitting support and at least a light-transmitting electroconductive layer and a photoconductive layer successively overlaid on the light-transmitting support, (ii) development means disposed substantially adjacent the photoconductive layer for supplying the developer onto the surface of the photoconductor to thereby develop a visible toner image from a latent electrostatic image, (iii) voltage application means for applying a voltage across the light-transmitting electroconductive layer and the development means, and (iv) exposure means disposed substantially adjacent the light-transmitting support and directed toward the development means, whereby the developer is brought into contact with the surface of the photoconductor, the developer comprising:

(a) an electroconductive magnetic carrier comprising a plurality of electroconductive magnetic carrier particles, each of the plurality of carrier particles comprising a magnetic base particle and an electroconductive layer formed on the surface of the magnetic base particle, the plurality of electroconductive magnetic carrier particles forming a magnetic brush for imparting an electric charge to the photoconductive layer when the developer is brought into contact with the photoconductor to thereby uniformly charge the surface of the photoconductor and erase any residual electric charge on the surface of photoconductor, (b) a magnetic high-resistivity carrier, and (c) an electrically insulating toner, wherein the electroconductive magnetic carrier has a volume resistivity of not greater than $10^6$ Ω.cm, and wherein the electroconductive magnetic carrier has a volume resistivity in a range between approximately $10^1$ Ω.cm and $10^4$ Ω.cm.

10. The developer of claim 1, wherein the magnetic high-resistivity carrier has a volume resistivity of not less than $10^6$ Ω.cm.

11. A developer for developing visible toner images from latent electrostatic images for use in an image formation system for forming a toner image by developing a latent electrostatic image formed corresponding to a light image on a photoconductor, the system comprising:

(i) a photoconductor comprising a light transmitting support and at least a light-transmitting electroconductive layer and a photoconductive layer successively overlaid on the light-transmitting support, (ii) development means disposed substantially adjacent the photoconductive layer for supplying the developer onto the surface of the photoconductor to thereby develop a visible toner image from a latent electrostatic image, (iii) voltage application means for applying a voltage across the light-transmitting electroconductive layer and the development means, and (iv) exposure means disposed substantially adjacent the light-transmitting support and directed toward the development means, whereby the developer is brought into contact with the surface of the photoconductor, the developer comprising:

(a) an electroconductive magnetic carrier comprising a plurality of electroconductive magnetic carrier particles, each of the plurality of carrier particles comprising a magnetic base particle and an electroconductive layer formed on the surface of the magnetic base particle, the plurality of electroconductive magnetic carrier particles forming a magnetic brush for imparting an electric charge to the photoconductive layer when the developer is brought into contact with the photoconductor to thereby uniformly charge the surface of the photoconductor and erase any residual electric charge on the surface of photoconductor, (b) a magnetic high-resistivity carrier, and (c) an electrically insulating toner, wherein the magnetic high-resistivity carrier has a volume resistivity of not less than $10^6$ Ω.cm, and wherein the magnetic high-resistivity carrier has a volume resistivity of not less than $10^7$ Ω.cm.

12. The developer of claim 1, wherein the ratio by weight of the electroconductive magnetic carrier to the magnetic high-resistivity carrier is in a range between approximately (95:5) and (60:40).

13. The developer of claim 12, wherein the ratio by weight of the electroconductive magnetic carrier to the magnetic high-resistivity carrier is in a range between approximately (90:10) and (75:25).

* * * * *